US005161560A

United States Patent [19]

Sheu

[11] Patent Number: 5,161,560

[45] Date of Patent: Nov. 10, 1992

[54] UMBRELLA HOLDER WITH RAINDROPS COLLECTING MEANS

[76] Inventor: Miin S. Sheu, No. 156, Cheng Kung Road, Changhua, Taiwan

[21] Appl. No.: 821,036

[22] Filed: Jan. 16, 1992

[51] Int. Cl.[5] ..... A45B 25/28

[52] U.S. Cl. ..... 135/15.1; 135/48

[58] Field of Search ..... 135/48, 15.1, 16

[56] References Cited

U.S. PATENT DOCUMENTS

| | | | |
|---|---|---|---|
| 423,990 | 3/1890 | Dattlebaum | 135/48 |
| 976,032 | 11/1910 | Bluff | 135/48 |
| 2,808,066 | 10/1957 | Pugliese | 135/48 |
| 3,809,107 | 5/1974 | Liu | 135/48 |
| 4,703,768 | 11/1987 | Lee | 135/48 |

FOREIGN PATENT DOCUMENTS

| | | | |
|---|---|---|---|
| 0141741 | 5/1935 | Austria | 135/33.2 |
| 917469 | 1/1947 | France | 135/48 |
| 7258 | of 1889 | United Kingdom | 135/48 |

*Primary Examiner*—David A. Scherbel
*Assistant Examiner*—Lan Mai
*Attorney, Agent, or Firm*—Bacon & Thomas

[57] ABSTRACT

For holding an umbrella and collecting the water therefrom, an umbrella holder comprising a casing, which has holes on the top for holding an umbrella and collecting raindrops carried by said umbrella and a shaft projecting over the bottom edge thereof, a sponge received inside said casing to absorb raindrops, a pressure rod movably secured to said casing by a cover, a gasket to seal the gap between said cover and said pressure rod, and a compression spring received in said pressure rod to support said casing in position. Squeezing said casing and said pressure rod against each other causes said sponge to be compressed to drain off the rain which was carried by an umbrella.

1 Claim, 5 Drawing Sheets

UMBRELLA HOLDER WITH RAINDROPS COLLECTING MEANS

BACKGROUND OF THE INVENTION

1. Field of the Invention

The present invention relates to umbrella holders and relates more particularly to an umbrella holder for holding an umbrella, which has means to absorb and collect the raindrops from an umbrella inserted therein.

2. Description of the Prior Art

At the gate of an office, a building, a store or a public place, an umbrella rack or holder may be provided for keeping umbrellas so as to prevent people from carrying a wet umbrella into a house. However, regular umbrella racks and holders are simply provided for keeping umbrellas and do not have means to collect the rain from the umbrellas held therein. Therefore, raindrops will drop from the umbrellas to wet the ground when wet umbrellas are kept in an umbrella rack or holder.

SUMMARY OF THE INVENTION

The present invention has been accomplished to eliminate the aforesaid problems. It is therefore an object of the present invention to provide an umbrella holder for keeping an umbrella, which has means to collect and absorb drain drops.

According to the present invention, there is provided an umbrella holder comprised of a casing, which has holes on the top for holding an umbrella and collecting raindrops carried by said umbrella and a shaft projecting over the bottom edge thereof, a sponge received inside said casing to absorb said raindrops, a pressure rod movably secured to said casing by a cover, a gasket to seal the gap between said cover and said pressure rod, and a compression spring received in said pressure rod to support said casing in position. When a pressure is applied at the top edge of the casing, the casing is caused to move downward relative to the pressure rod, and therefore, the sponge is compressed to drain off the water. When the umbrella holder is used in keeping an umbrella, the gap between the cover and the pressure rod is sealed, and therefore, the rain carried by the umbrella which is held therein is prohibited from flowing out of the casing. After each squeeze, the compression spring will automatically push the casing and the sponge back to their original position and shape.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENT

Figure 1:
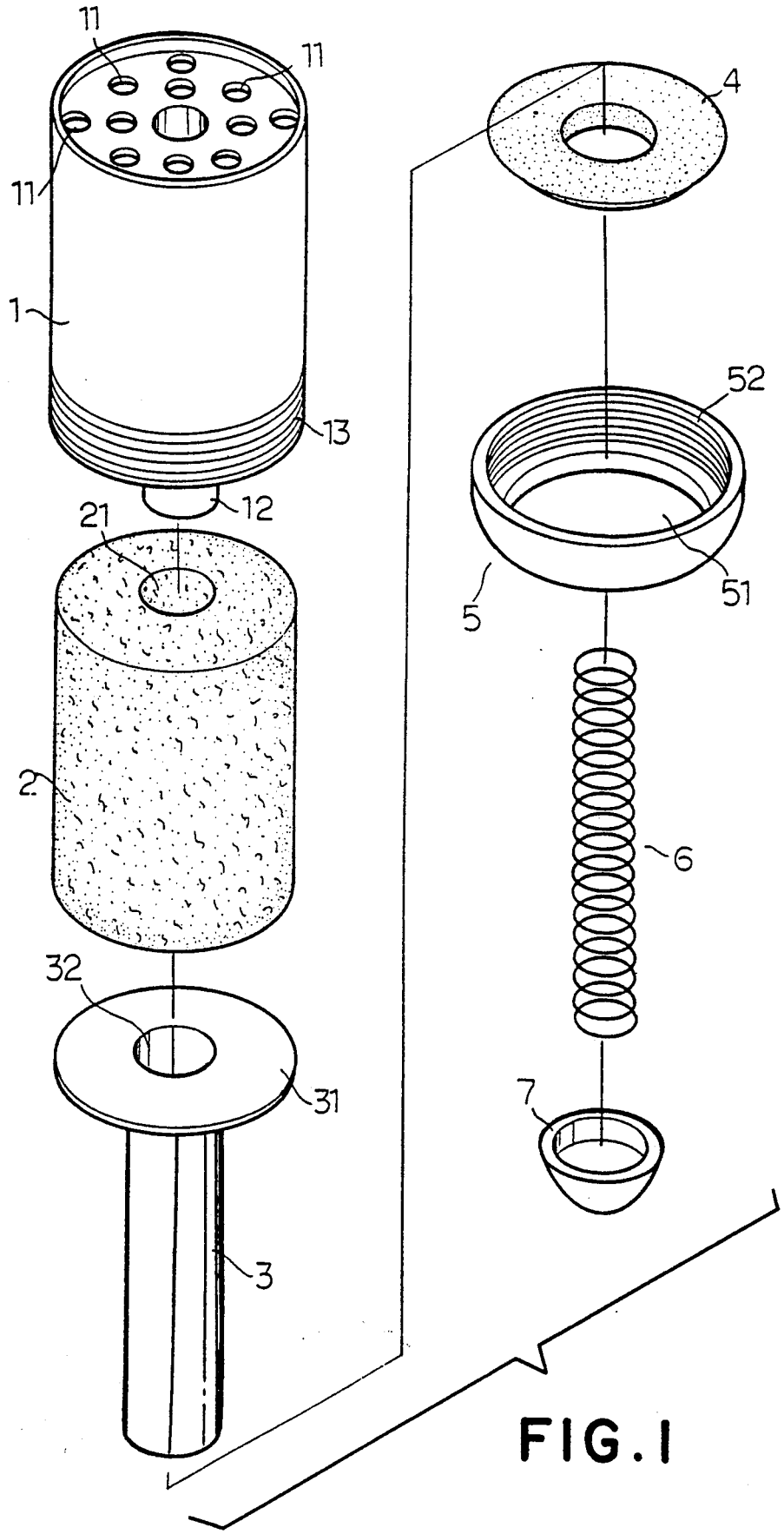
FIG. 1 is an exploded perspective view of the preferred embodiment of the umbrella holder of the present invention.
Figure 2:
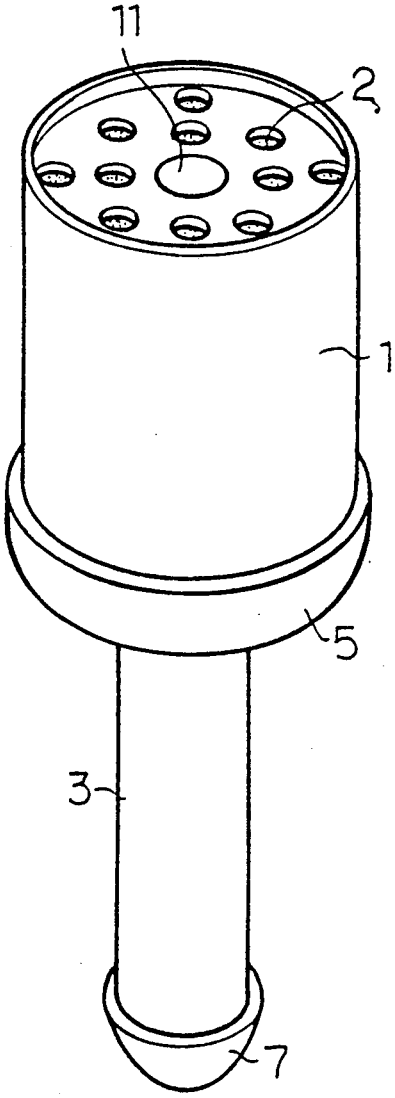
FIG. 2 is a perspective assembly view thereof.

Referring to FIGS. 1 and 2, therein illustrated is an umbrella holder embodying the present invention and generally comprised of a casing 1, a sponge 2, a pressure rod 3, a rubber gasket 4, a cover 5, a compression spring 6, and an anti-slid cap 7. The casing 1 is made in a cylindrical shape, having a plurality of water inlet holes 11 on the closed top end thereof, a hollow shaft 12 extending from the closed top end thereof and projecting out of the opened bottom end thereof, and an outer thread 13 around the bottom edge thereof. The sponge 2 is made in shape tightly fitting the holding space inside the casing 1, having a through hole 21 through the central axis thereof for inserting the hollow shaft 12 of the casing 1. The cover 5 has an inner thread 52 corresponding to the outer thread 13 on the casing 1, and a center hold 51 for inserting the pressure rod. The pressure rod 3 is made from a tube having a flange 31 at one end and a boring bore 12 through the central axis thereof.

Referring to FIGS. 1 and 2 again, during the assembly process of the present invention, the sponge 2 is mounted on the hollow shaft 12 and received inside the casing 1 and stopped by the flange 31 on the pressure rod 3, and the compression spring 6 is inserted into the boring bore 32 inside the pressure rod 3, and then, the cover 5 is sleeved on the pressure rod 3 and attached to the casing 1 by engaging the inner thread 52 thereof with the outer thread 13 on the casing 1 to secure the flange 31 of the pressure rod 3 to the casing 1. Before attaching the cover 5 to the casing 1, the rubber gasket 4 is put inside the cover 5 and squeezed in between the flange 31. Once the anti-skid cap 7 is fastened on the pressure rod 3 at the end opposite to the flange 31, the assembly process of the present invention is finished.

Figure 3:
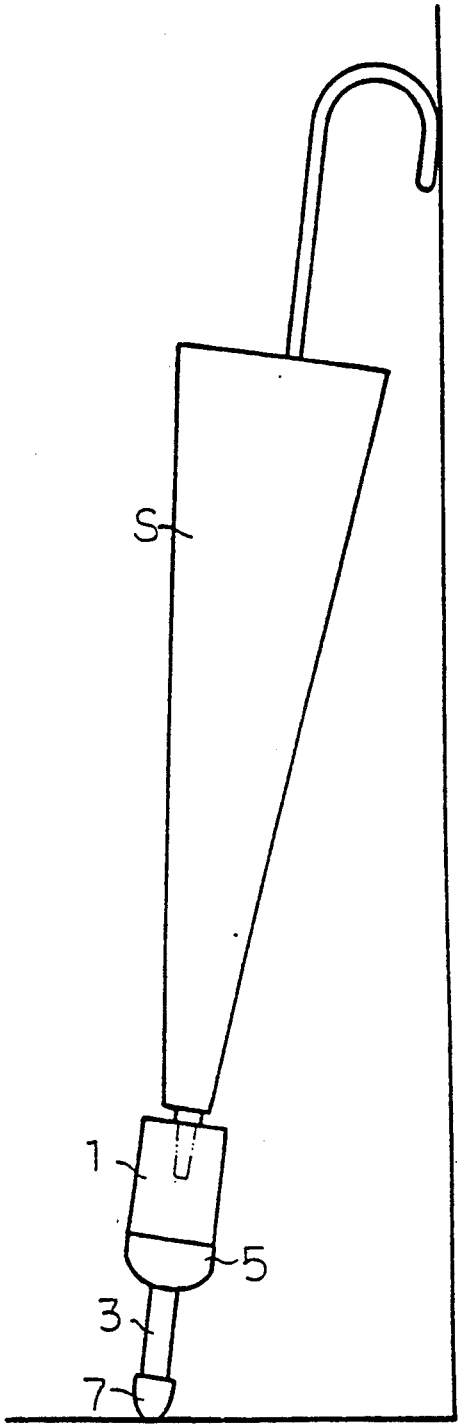
FIG. 3 is a plan view showing the use of the present invention in holding an umbrella.
Figure 4:
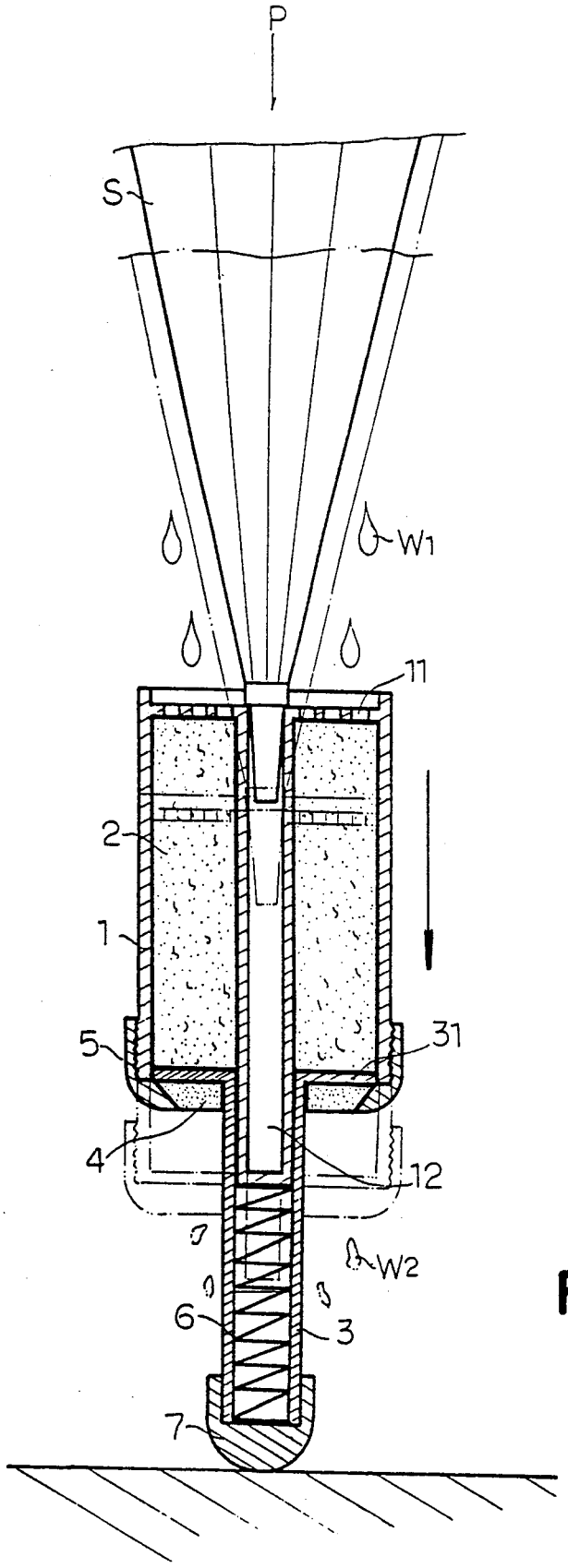
FIG. 4 is a sectional view showing the use of the present invention in collecting the raindrops from an umbrella inserted therein.

Referring to FIG. 4 and seeing FIG. 3 again, when an umbrella S is inserted into either water inlet hole 11 on the casing 1, raindrops W1 from the umbrella S will drop into the casing 1 through the water inlet holes 11 and soon be absorbed by the sponge 2 (see also the real line in FIG. 4).

Referring to FIG. 4 again, when a pressure is applied on the umbrella S against the pressure rod 3, the top edge of the casing 1 and the flange 31 of the pressure rod 3 are relatively moved toward each other to compress the sponge 2, and at the same time, the gasket 4 is lifted from the center hole 51 for draining water W2 out of the cover 5 through the center hole 51.

Figure 5:
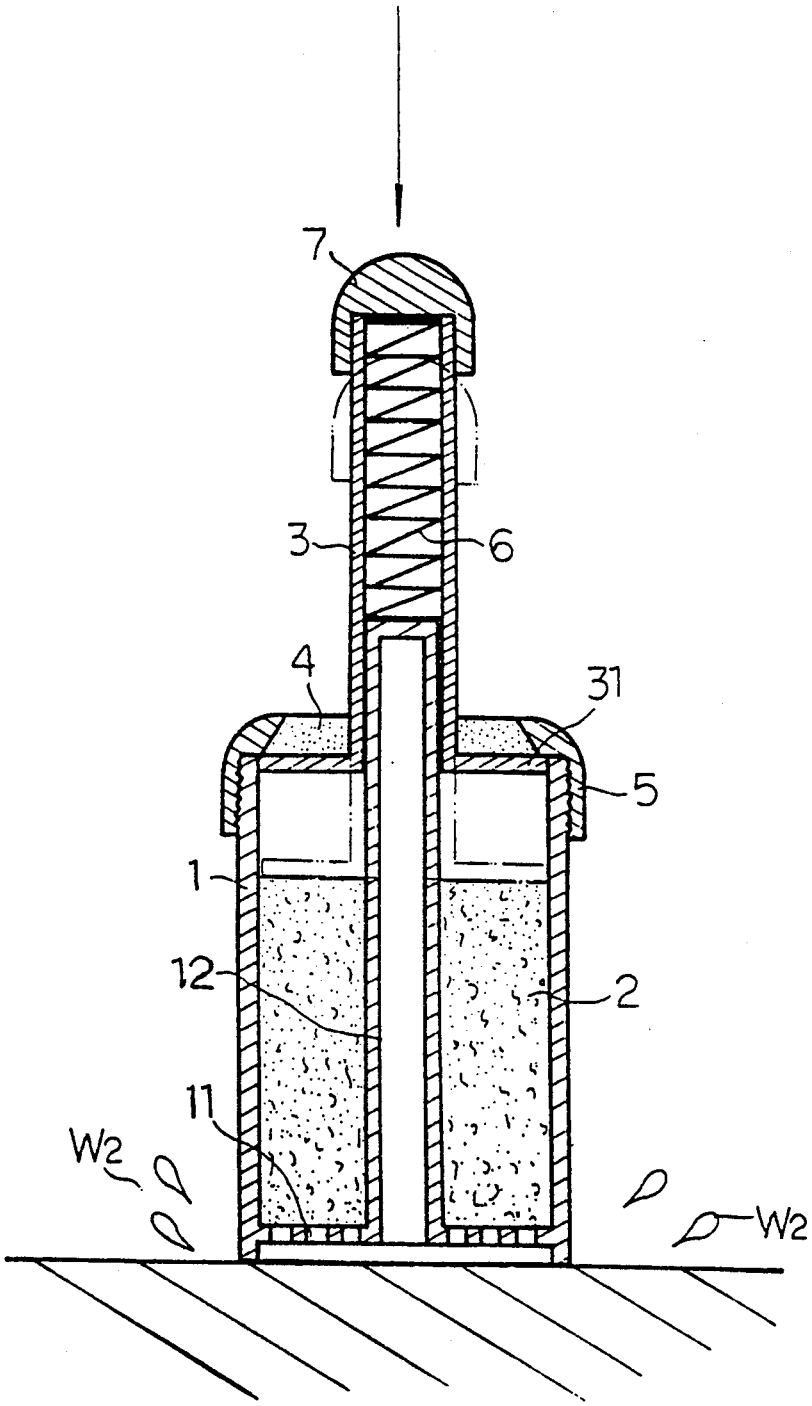
FIG. 5 is another sectional view showing that the umbrella holder is turned upside-down and forced by an external pressure to squeeze out the water contained therein.

Referring to FIG. 5, the umbrella holder may be turned upside-down and placed on the ground, after the removal of the umbrella therefrom, and then, apply a pressure on the anti-skid cap 7 against the ground to squeeze water W2 out of the sponge 2 for draining out of the casing 1 through the water inlet holes 11. After each squeeze, the compression spring 3 immediately push the sponge 2 and the casing 1 back to their original position and shape.

I claim:

1. An umbrella holder for holding an umbrella and collecting the water therefrom, the holder comprising:

a cylindrical casing, said cylindrical casing having a plurality of water inlet holes on the closed top end thereof for inserting an umbrella and collecting raindrops from said umbrella, a hollow shaft extending from the closed top end thereof and projecting out of the opened bottom end thereof, and an outer thread around the bottom edge thereof;

a sponge received inside said cylindrical casing and stopped at said water inlet holes, said sponge having a through hole through the central axis thereof for inserting said hollow shaft;

a pressure rod to hold said casing, said pressure rod being made from a tube having a flange at one end stopped against said sponge toward said water inlet holes, and a boring bore through the central axis thereof for inserting said hollow shaft, said flange having an outer diameter approximately equal to the inner diameter of said casing;

a cover covered on said casing at its opened bottom end to secure said flange to said casing, said cap having an inner thread engaged with said outer thread, and a center hole for inserting said pressure rod, said center hole being made in diameter smaller than said flange;

a compression spring received in said boring bore of said pressure rod and stopped against said hollow shaft of said casing; and a gasket placed inside said cover and pressed by said flange of said pressure rod to seal off the center hole of said cover.

* * * * *